US005626317A

United States Patent [19]

Altman

[11] Patent Number: 5,626,317

[45] Date of Patent: May 6, 1997

[54] REPLACEMENT MAILBOX POST

[76] Inventor: William R. Altman, 2233 Bemiss Rd., Valdosta, Ga. 31602

[21] Appl. No.: 494,373

[22] Filed: Jun. 26, 1995

[51] Int. Cl.[6] ..... F16L 3/00

[52] U.S. Cl. ..... 248/121; 248/218.4; 248/224.8

[58] Field of Search ..... 248/121, 125.8, 248/218.4, 219.2, 219.4, 222.41, 224.7, 224.8

[56] References Cited

U.S. PATENT DOCUMENTS

| | | | |
|---|---|---|---|
| 704,884 | 7/1902 | Lally | 248/218.4 X |
| 3,223,487 | 12/1965 | Jafelice | 248/219.4 X |
| 3,289,988 | 12/1966 | McKenney et al. | 248/220.42 X |
| 3,721,463 | 3/1973 | Attwood et al. | 248/219.2 X |
| 3,790,116 | 2/1974 | Schulman | 248/218.4 X |
| 3,817,394 | 6/1974 | Saiki | 248/218.4 X |
| 4,300,739 | 11/1981 | Sande | 248/219.4 |
| 4,372,450 | 2/1983 | Licari et al. | 248/222.41 X |
| 5,230,176 | 7/1993 | Schomaker | 248/218.4 X |
| 5,335,471 | 8/1994 | Kupiec | 248/218.4 X |

FOREIGN PATENT DOCUMENTS

| | | | |
|---|---|---|---|
| 923871 | 4/1973 | Canada | 248/218.4 X |

*Primary Examiner*—Derek J. Berger
*Assistant Examiner*—Richard M. Smith
*Attorney, Agent, or Firm*—Woodard, Emhardt, Naughton, Moriarty & McNett

[57] ABSTRACT

A replacement mailbox post for mounting onto an old mailbox post. A four sided vertically extending replacement post has a hollow interior sized to mount to the old mailbox post. The internal cross-sectional area of the replacement post is geometrically compatible with the old post. A horizontally extending shelf has a proximal end extending into a pair of internal slots formed in the replacement post. A wall perpendicularly joined to the shelf extends downwardly therefrom at the proximal end covering an opening in the replacement post. Fastening devices extend through the replacement post into the wall. Additional fastening devices secure the replacement post to the old post. A decorative cover is mounted atop an encloses the hollow interior of the replacement post.

5 Claims, 3 Drawing Sheets

REPLACEMENT MAILBOX POST

BACKGROUND OF THE INVENTION

1. Field of the Invention

This invention is in the field of vertical posts and more specifically those used support a mailbox.

2. Description of the Prior Art

Rural mailboxes and in many cases city mailboxes utilize a vertical post having a bottom end sunk in the ground and secured thereto by sand, stones or concrete. Cantileverly mounted to the post is a horizontally extending shelf upon which the standard rural mailbox is mounted. The posts take a variety of configurations; however, most of the configurations include both a vertical post and a horizontally extending shelf.

The mailbox post is mounted adjacent the road and is subjected to not only weather deterioration but also vehicle impacts and vandalism. The net result is that the owner occasionally has to replace the mailbox, the shelf and even the post. The replacement is time consuming and a bother since in many cases the post is finely mounted to the ground.

Disclosed herein is a replacement mailbox post which is erected by installing the post onto and around the previously used post without requiring removal of the old post from the ground. As a result, an attractive new mailbox post is provided and may be installed easily and quickly without requiring the traditional hole digging and concrete mixing.

SUMMARY OF THE INVENTION

One embodiment of the present invention is a mailbox holder mountable upon an upright post in the ground including a vertically extending post having a hollow interior sized to mount to the upright post. The hollow interior has an internal cross sectional area larger than the upright post but is geometrically compatible therewith to allow the vertically extending post to be slipped onto and completely around the upright post. The vertically extending post has a bottom end and a top end with the hollow interior extending from the bottom end toward the top end a sufficient distance allowing the upright post to be located therein when the bottom end rests atop the ground. A horizontally extending shelf is mounted to the vertically extending post. A first fastener secures the shelf to the vertically extending post and a second fastener secures the vertically extending post to the upright post. A third fastener secures the shelf to a mailbox.

It is an object of the present invention to provide a replacement mailbox post.

A further object of the present invention is to provide a mailbox post which may be erected without requiring the traditional hole digging and concrete mixing.

Yet a further object of the present invention is to provide an attractive mailbox post which may be mounted onto and around a previously erected mailbox post.

Related objects and advantages of the present invention will be apparent in following description.

DESCRIPTION OF THE PREFERRED EMBODIMENT

Figure 1:
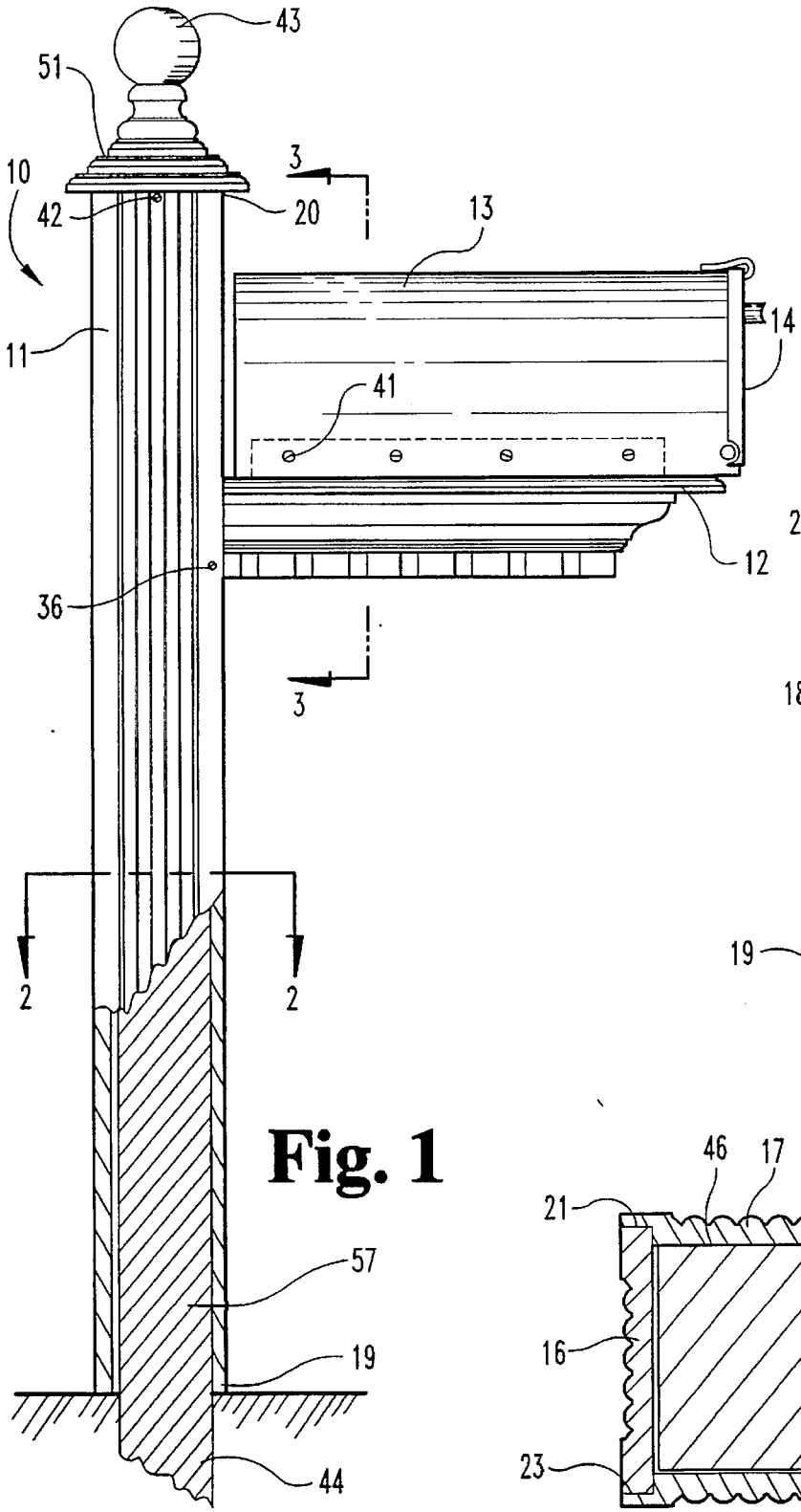
FIG. 1 is a fragmentary side view of my new mailbox post mounted to an old mailbox post.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
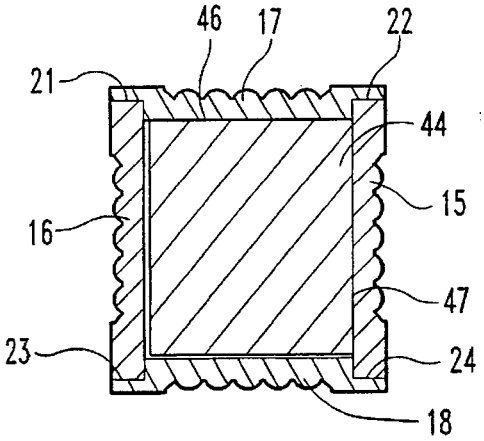
FIG. 2 is an enlarged cross-sectional view taken along a line and viewed in the direction of the arrows 2—2 of FIG. 1.

Referring now more particularly to FIG. 1, there is shown a mailbox construction 10 including the replacement mailbox post 11, the mailbox shelf 12 mounted to post 11 and a conventional rural mailbox 13 mounted atop shelf 12 and having the conventional hinged access door 14 pivotally mounted thereto. Replacement post 11 includes a pair of sidewalls 15 and 16 (FIG. 2) fixedly mounted by conventional fastening devices to a pair of end walls 17 and 18. Walls 15 and 16 are parallel and extend from the bottom end 19 of the post to the top end 20 of the post. Likewise, walls 17 and 18 are parallel and extend from end 19 to end 20. A pair of internal ledges 21 and 22 are formed on the inward facing surface of wall 17. Likewise, a second pair of ledges 23 and 24 are formed on the inward facing surface of wall 18 and are aligned respectively with ledges 21 and 22. The opposite longitudinally extending edge portions of wall 16 fit into ledges 21 and 23 and are secured thereto by conventional fastening devices. Likewise, the opposite longitudinally extending edge portions of wall 15 fit into ledges 22 and 24 and are secured thereto by conventional fastening devices. Walls 16 and 15 are spaced apart a distance less than the distance between walls 17 and 18 thereby providing a rectangular cross-sectional area for the hollow interior of the post. The hollow interior is constant in cross-section from bottom end 19 to top end 20.

Figure 3:
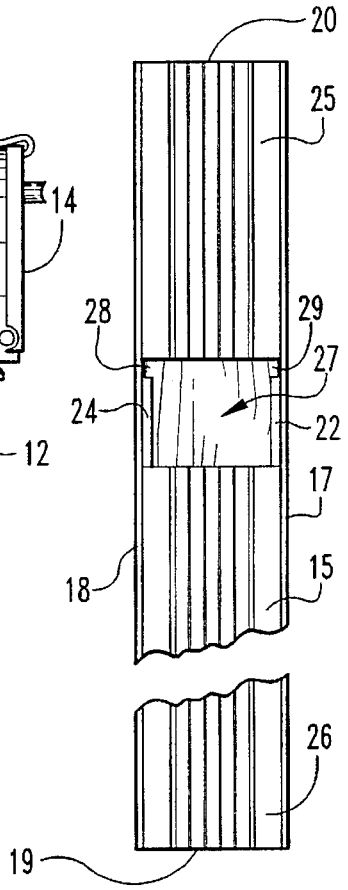
FIG. 3 is a fragmentary side view looking in the direction of arrows 3—3 of FIG. 1 with the mailbox shelf removed from the post.

Shelf 12 is cantileverly mounted to post 11 and has been removed from the post in FIG. 3 to illustrate the construction of the post at the junction of the post and the shelf. Wall 15 includes an upper portion 25 spaced apart from a lower portion 26 forming an opening 27 therebetween. A pair of grooves 28 and 29 are provided in respectively ledges 24 and 22 of walls 18 and 17. Grooves 28 and 29 are spaced apart a distance greater than the spacing between ledges 24 and 22 but less than the spacing between walls 18 and 17. Grooves 28 and 29 are parallel and are aligned and extend from opening 27 toward wall 16.

Figure 7:
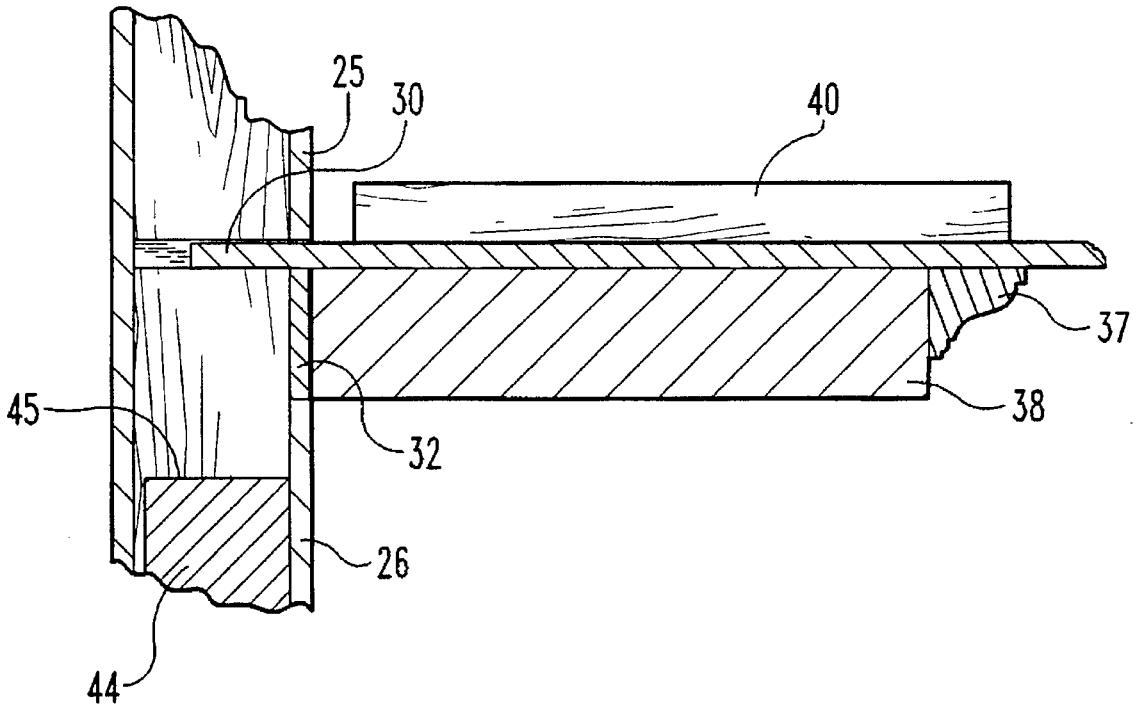
FIG. 7 is a fragmentary cross-sectional view showing the shelf mounted to the new post.

Shelf 12 is cantileverly mounted to post 11 and includes a proximal end 30 (FIG. 4) having a width 35 equal to slightly less than the spacing between grooves 28 and 29. Likewise, the thickness 31 (FIG. 5) of proximal end 30 is equal to slightly less than the height of each slot 28 and 29 thereby allowing proximal end 30 (FIG. 7) to extend into slots 28 and 29 mounting the shelf to the post.

Figure 4:
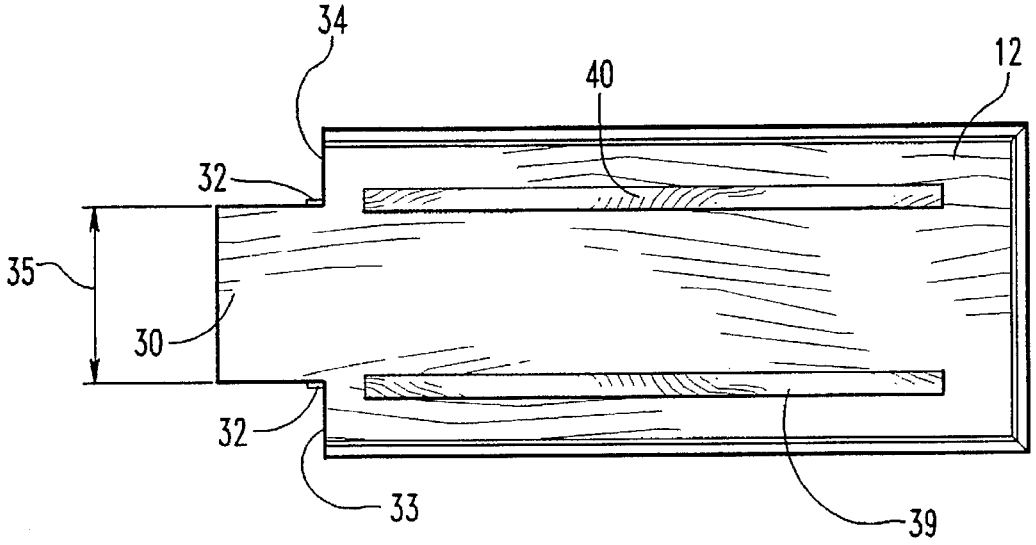
FIG. 4 is a top view of the shelf with the mailbox removed.
Figure 5:
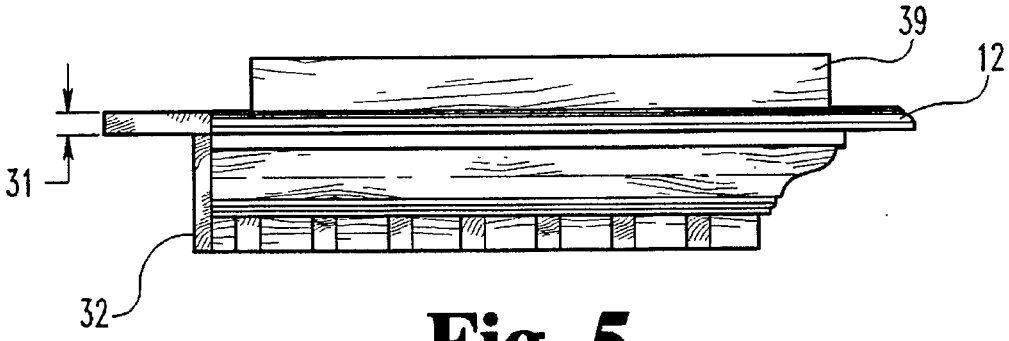
FIG. 5 is a side view of the shelf of FIG. 4.
Figure 6:
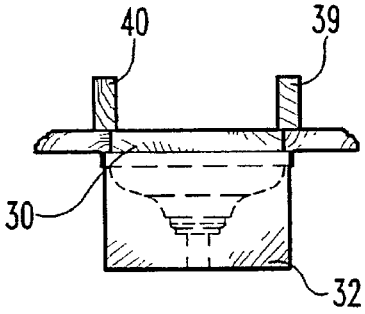
FIG. 6 is a left end view of the shelf of FIG. 5.

Wall 32 (FIG. 5) is perpendicularly attached to and extends downwardly from shelf 12 and is located to the left of edges 33 and 34 of the shelf as shown in FIG. 4. Wall 32 is sized to fit in opening 27 resting upon ledges 24 and 22 being aligned with the lower portion 26 (FIG. 7) of wall 15. Conventional fastening devices 36 (FIG. 1), such as nails, extend through walls 17 and 18 and into the opposite edge portions of wall 32 thereby securing the shelf to the post. Decorative horizontally extending molding 37 and 38 may be fixedly attached to and beneath the shelf extending outwardly from wall 32.

The conventional mailbox 13 includes a pair of sidewalls fixedly attached to the bottom wall of the mailbox not shown with the bottom wall of the mailbox being recessed. A pair of parallel rails 39 and 40 (FIG. 4) are fixedly mounted atop shelf 12 and are spaced apart to fit inwardly of the sidewalls of the mailbox and between the top surface of shelf 12 and the downwardly facing surface of the mailbox bottom wall. Conventional fastening devices 41 (FIG. 1) extend through the sidewalls of the mailbox and into parallel rafts 39 and 40 securing the mailbox atop shelf 12.

In order to assemble the post, post 11 is placed on the ground with opening 27 facing up. Shelf 12 is then mounted to the post by extending proximal end 30 into slots 28 and 29 with a short nail or fastener 36 then being driven through walls 17 and 18 into wall 32. Cover 51 (FIG. 1) is then mounted to the top end 20 of the post. Cover 51 includes a depending portion sized to fit within the hollow interior of post 20 with conventional fastening devices 42 then being used to secure the depending portion of cover 51 to walls 17 and 18 of the post. A decorative piece or ball 43 is fixedly mounted atop cover 51 with the cover capping the hollow interior of the post and limiting rain from entering therein. The cover as well as all walls of post 11 and shelf 12 may be produced from wood although other materials are contemplated and included in the present invention.

The mailbox post 10 is designed to mount to an existing upright post 44 which may be the old damaged mailbox post mounted to and extending above ground level. The top end portion including the shelf of the old post 44 may be removed by sawing off the top portion of the old post leaving the top end 45 (FIG. 7) of post 44 having a height above ground less then shelf 12 when the new post is mounted to the old post. The hollow interior of post 11 is sized to mount to post 44 and thus must have an internal cross-sectional area larger than post 44 but is geometrically compatible therewith to allow the vertically extending post 11 to be slipped onto and completely around post 44 with the bottom end 19 of post 11 resting atop and contacting ground. Since most of the currently used posts 44 have a rectangular cross-section, post 11 has been designed with a compatible rectangular hollow interior. The hollow interior of post 11 extends from bottom end 19 to top end 20 a sufficient distance or a distance greater than the height of end 45 of post 44 once the top end of the old post has been removed. In one embodiment, post 44 is cut to position end 45 between 24 inches to 36 inches above ground level.

Post 11 is positioned so that walls 15 and 17 are in contact with the adjacent surfaces 46 and 47 (FIG. 2) of post 44 with conventional fastening devices, such as nails 57 (FIG. 1) extending respectively through walls 15 and 17 and through surfaces 47 and 46 thereby fixedly securing post 11 to post 44. In the event mailbox post 10 is not to be mounted to an old post 44, then it is necessary to first mount a post to the ground level identical to post 44 with the resultant steps being taken as previously described from mounting post 11 to post 44.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A mailbox holder mountable upon an upright post in the ground comprising:

a vertically extending post having a hollow interior sized to mount to the upright post, said hollow interior having an internal cross sectional area larger than said upright post but being geometrically compatible therewith to allow said vertically extending post to be slipped onto and completely around said upright post, said vertically extending post having a bottom end and a top end with said hollow interior extending from said bottom end toward said top end a sufficient distance allowing said upright post to be located therein when said bottom end is adapted to rest atop and contact the ground;

a horizontally extending shelf mounted to said vertically extending post;

first fastening means securing said shelf to said vertically extending post;

second fastening means securing said vertically extending post to said upright post;

third fastening means operable to secure said shelf to a mailbox;

a cover mounted to said top end of said vertically extending post capping said hollow interior and limiting rain from entering therein;

a pair of parallel mailbox mounting rails mounted atop said shelf, said shelf includes a proximal end and a distal end and is cantileverly mounted to said vertically extending post, said rails extend from said vertically extending post outwardly toward said distal end of said shelf and are spaced apart to fit beneath the mailbox located thereatop; and wherein:

said vertically extending post includes a pair of wooden side walls with opposite longitudinally extending edge portions and a pair of wooden end walls connected together in a rectangular configuration with said side walls and said end walls extending from said bottom end toward said top end, said hollow interior having a rectangular cross sectional area formed by said side walls and said end walls;

one of said side walls includes a shelf mounting opening, said end walls have mutually facing surfaces with parallel and aligned grooves formed therein extending from said opening in said one of said side walls toward the other of said side walls, said shelf extends horizontally into said grooves and said hollow interior.

2. The mailbox holder of claim 1 wherein:

said end walls include a pair of vertically extending internal ledges adjacent to and fittingly receiving said opposite longitudinally extending edge portions of said one of said side walls;

said shelf includes a cap wall perpendicularly joined thereto and extending downwardly therefrom, said cap wall is positioned adjacent said ledges and extends across and closes said opening supporting said shelf relative to said vertically extending post.

3. The mailbox holder of claim 2 wherein:

said side walls are spaced apart a first dimension and said end walls are spaced apart a second dimension with said first dimension less than said second dimension.

4. A mailbox holder mountable upon an upright post in the ground comprising:

a vertically extending post having a hollow interior sized to mount to the upright post, said hollow interior having a rectangular internal cross sectional area larger than said upright post but being geometrically compatible therewith to allow said vertically extending post to be slipped onto and completely around said upright post, said vertically extending post having a bottom end and a top end with said hollow interior extending from said bottom end toward said top end a sufficient distance allowing said upright post to be located therein when said bottom end is adapted to rest atop and contact the ground, said vertically extending post includes a pair of side walls and a pair of end walls joined together in a rectangular configuration with said side walls and said end walls extending from said bottom end toward said top end, said rectangular cross sectional area formed by said side walls and said end walls, said side walls including one side wall having a slot with width and height extending thereacross leading into said hollow interior;

a horizontally extending and cantileverly mounted shelf with a proximal end and a distal end, said proximal end extending into said slot and having a thickness less that the height of said slot, said proximal end further having a width less than the width of said slot and less than said shelf forming a pair of outwardly extending edges extending outwardly of said vertically extending post and contacting said vertically extending post at opposite ends of said slot;

a mailbox mounting projection atop said shelf, said projection spaced apart from said vertically extending post but extending away therefrom in a direction from said proximal end toward said distal end of said shelf to fit beneath the mailbox located thereatop;

first fastening means securing said shelf to said vertically extending post;

second fastening means securing said vertically extending post to said upright post; and, third fastening means operable to secure said shelf to a mailbox.

5. The combination of:

an old mailbox post having a removed top end, said post mounted to and extending vertically out of the ground, said old mailbox post having an outwardly facing surface;

a vertically extending replacement post having a hollow interior sized to mount to the old mailbox post and having an inwardly facing surface, said hollow interior having a rectangular internal cross sectional area larger than said old mailbox post but being geometrically compatible therewith to allow said vertically extending replacement post to be slipped onto and completely around said old mailbox post, said replacement post having a bottom end and an upper end with said hollow interior extending from said bottom end toward said upper end a sufficient distance allowing said old mailbox post to be located therein when said bottom end is adapted to rest atop and contact the ground, said replacement post includes a pair of side walls and a pair of end walls joined together in a rectangular configuration with said side walls and said end walls extending from said bottom end toward said upper end, said rectangular cross sectional area formed by said side walls and said end walls, said side walls including one side wall having a slot with width and height extending thereacross leading into said hollow interior;

a horizontally extending and cantileverly mounted shelf with a proximal end and a distal end, said proximal end extending into said slot and having a thickness less than the height of said slot, said proximal end further having a width less than the width of said slot and less than said shelf forming a pair of outwardly extending edges extending outwardly of said replacement post and contacting said replacement post at opposite ends of said slot;

a mailbox mounting projection atop said shelf, said projection spaced apart from said replacement post but extending away therefrom in a direction from said proximal end toward said distal end of said shelf to fit beneath the mailbox located thereatop;

first fastening means securing said shelf to said replacement post;

second fastening means securing said replacement post to said old mailbox post and holding said inwardly facing surface of said replacement post in contact with said outwardly facing surface of said old mailbox post; and, third fastening means operable to secure said shelf to a mailbox.

* * * * *